US006276037B1

(12) United States Patent
Solfronk

(10) Patent No.: US 6,276,037 B1
(45) Date of Patent: Aug. 21, 2001

(54) RIVETING TOOL

(75) Inventor: Antonin Solfronk, Albrechtice Nad Vlatavou (CZ)

(73) Assignee: MS Verwaltungs- und Patenges mBH (DE)

( * ) Notice: Subject to any disclaimer, the term of this patent is extended or adjusted under 35 U.S.C. 154(b) by 0 days.

(21) Appl. No.: 09/469,685

(22) Filed: Dec. 22, 1999

(30) Foreign Application Priority Data

Dec. 22, 1998 (DE) ..... 298 22 652 U

(51) Int. Cl.[7] ..... B21J 15/22
(52) U.S. Cl. ..... 29/243.525; 72/391.4
(58) Field of Search ..... 29/243.523, 243.524, 29/243.525; 72/391.4

(56) References Cited

U.S. PATENT DOCUMENTS 4,454,746 * 6/1984 Schwab ..... 29/243.525
4,598,571 * 7/1986 Oefinger ..... 29/243.523
4,648,258 * 3/1987 Frearson ..... 29/243.525
4,770,023 * 9/1988 Schwab ..... 29/243.525
4,887,450 * 12/1989 Gast et al. ..... 29/243.525
4,888,974 * 12/1989 Mandell ..... 29/243.523
5,072,501 * 12/1991 Vincenzo ..... 29/243.525
5,490,311 * 2/1996 Rosier ..... 29/243.525
5,500,990 * 3/1996 Wihan ..... 29/243.525

* cited by examiner

*Primary Examiner*—David Jones

(57) ABSTRACT

A riveting tool for setting blind rivets and/or bolts with lock washers has a mouthpiece to receive blind rivets and/or bolts, a pneumatic device to carry away broken-off rivet pins from the riveting tool, a pressable device arranged on the riveting tool that releases a course of functions relating to a riveting process, a valve device for supplying air to the pneumatic device to carry away broken-off rivet pins from the riveting tool, and a handle to hold the riveting tool. The valve device includes an actuating device that controls the air supplied to the pneumatic device to carry away broken-off rivet pins, the actuating device being arranged on the handle.

21 Claims, 5 Drawing Sheets

RIVETING TOOL

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates to a riveting tool for setting blind rivets and/or bolts with lock washers, with a mouthpiece to receive blind rivets and a pneumatic device for carrying away broken-off rivet pins from the rivet setting tool, in which the course of the functions relating to the riveting process is released by a press button arranged on the riveting tool, with a valve device for the supply of air to the pneumatic device for removal.

2. Discussion of Relevant Art

Such riveting tools are known and are designed such that they can be used for riveting with rivets of different sizes and types. In the processing of the abovementioned rivets with the rivet setting tools that can be found in the state of the art, the rivet pins are separated from the rivet head and are caught in a collecting receptacle which is fitted to the riveting tool. The removal of the rivet pin from the mouthpiece of the riveting tool to the collecting receptacle takes place here by a pin extraction device or pneumatic device by means of which the rivet pins are conveyed from the riveting tool chuck into the collecting receptacle. By collecting the rivet pins, firstly the safety of working is increased, and secondly after the rivets have been introduced with the rivet pin into the mouthpiece, that is, still before the riveting process proper, the rivets are secured against falling out of the mouthpiece by the actuation of the pin extraction device and the thereby ensured suction intake pressure. A possibility of its importance in practice, and in particular for a frictionless course of work, is not to be underestimated.

Several sets of solutions for the provision of the abovementioned intake or extraction suction pressures in the approaches to the riveting process are given in the prior art.

In this connection, the pneumatic supply to the pin extraction device takes place, among other things, in that the pin extraction suction takes place by means of separate compressed air valves at the input of the compressed air supply to the riveting tool or to its head. However, it has been found in practice to be disadvantageous, both that the air supply metering is complicated, since as a rule two hands are required, in order to be able to effect a setting on the appliance, and in order that no automatic shutoff of the compressed air takes place, so that compressed air is often consumed in the pauses and in other work interruptions, even when it is not being made use of at all.

To prevent the described negative results of a pin extraction which operates separately from the proper function of the riveting tool proper, and thus permanently, a riveting tool is given in the state of the art in which a compressed air supply system is arranged in the handle region and consists of a compressed air feed channel, a supply valve and a supply channel, such that by the actuation of a push button over two positions, firstly compressed air is released for intake suction of the rivets, and only in the second operating position is the feed device of the riveting tool actuated. Such a device is described in EP 0 302128 of the Applicant's assignee, MS Verwaltungs-und Patentges.mbH.

Even though the embodiment of the riveting tool described above represents an important advance as a starting point of the development of riveting tools, ergonomic aspects have developed from practice, in particular in use in the industrial field, because of which the use of the existing riveting tool can give rise to problems. The reasons for these problems are, among other things, that the uniting of two functions, namely the intake suction and the working functions, in one press button, is contrary to the aim of automating the sequence of certain work sequences, i.e. to be able to carry them out without mental work, since the user always has to mentally distinguish the two states during the use of the riveting tool.

SUMMARY OF THE INVENTION

The invention therefore has as its object to provide a riveting tool of the category concerned, which avoids the above disadvantages and leads to a riveting tool which is easier to manipulate.

This object is attained by a riveting tool for setting blind rivets and/or bolts with lock washers, comprising: a mouthpiece to receive blind rivets and/or bolts, a pneumatic device to carry away broken-off rivet pins from said riveting tool a pressable device arranged on said riveting tool that releases a course of functions relating to a riveting process, a valve device for supplying air to said pneumatic device to carry away broken-off rivet pins from said riveting tool, and a handle to hold said riveting tool, wherein said valve device includes an actuating device that controls said air supplied to said pneumatic device to carry away broken-off rivet pins, said actuating device being arranged on said handle.

In that a riveting tool of the category concerned is provided with a valve device for the air supply to the pneumatic device for carrying away broken-off rivet pins, wherein the valve device includes an actuating device situated on the handle of the riveting tool or integrated into the handle, for the control of the air supply to the pneumatic device for carrying away broken-off rivet pins, firstly a possibility is provided so that by gripping the tool with the hand, the wording sequences of the intake suction or extraction suction and of the riveting can be mutually changed over separately and ergonomically optimized.

In an advantageous development of the subject of the invention, the actuating device for the actuation of the pneumatic intake suction or extraction suction is arranged directly beneath the press button. The actuating device is hence situated in the handle region of the riveting tool. In this manner it can be insured that an actuation of the actuating device can be carried out with the same hand that holds the riveting tool during the use of the tool. Furthermore, by means of such an arrangement, the result is attained that the actuating process of the valve device is preferably actuated by the middle finger of the hand and in a particularly preferred form is also operable by the middle, ring, and little fingers. Here it was considered that, particularly during prolonged use of the riveting tool, the middle finger, or the three above-named fingers in common, besides the index finger, are suitable for switching an actuating member.

In a particularly positive development of the invention, a control bolt has been found suitable as the actuating device for manual actuation of a valve control pin in the frame of the valve device. The control bolt can be in the form of a pin. If the control bolt or control pin is installed in connection with a valve pin to be actuated, the distance of which to one or more valve chambers is adjustable, it is inserted at a given angle, but preferably perpendicular to the longitudinal axis of the valve pin, in a passage opening beneath the press button. The control bolt then has a substantially, and preferably, cylindrical shape. Such a comparatively simple mechanical embodiment of the actuating device has been found to be particularly robust and practicable. The control bolt or control pin can be made of different materials with suitable strength. Thus metals and also plastics have been found suitable. Here plastics have the known advantage of their light weight and, in crosslinked form, possess a high strength.

In a most positive development of the subject of the invention, the control bolt is fitted into an opening, and has a shape such that it can be actuated in the bolt opening both in the longitudinal direction and also transversely of the longitudinal direction. According to the embodiment, both directions of motion are to be made possible simultaneously or selectively. It is then possible to also adjust the valve control pin very advantageously by means of a tilting motion of the control bolt, and thus to control the valve device by means of the control bolt. Because of this, the control bolt has a tapered shape, which at its thickest cross section preferably fits the bore in which the control bolt was installed, and whose tapered side stands out from the opening of the bore. The said vertical tilting of the bolt within the bore can be very simply effected in this manner. The attainable stroke can in particular be set by the degree to which the taper of the control bolt is marked.

For an improvement of the tilting motion, the control bolt is rotatably mounted on one side. The mounting takes place very simply in the manner of a ball joint, in that the end of the control bolt situated in the opening has a rounded portion which corresponds to the bore floor, and is thus rotatable against this.

Furthermore, in a positive development, a lever is installed on the portion of the bolt which projects out of the opening, and by means of it the bolt can be brought into different tilting positions by simply gripping the riveting tool, in order thus to be able to displace the valve pin in the axial direction.

The control bolt is arranged with respect to the head of the valve control pin such that its underside is substantially situated in abutment with the head side of the valve control pin. The control bold itself has, in a preferred manner, one or more notches, grooves, or recesses on the underside of its upper surface, formed in a manner such that the head of the valve control pin can be received or can be lowered into these, so that these serve as working surfaces. The control of the axial movement of the valve control pin is on the one hand effected in that the control bolt is pushed into the guide opening or pulled out of it, and on the other hand by a tilting in a substantially radial direction of the control bolt relative to the longitudinal axis of the passage opening and along the longitudinal axis of the control pin. The valve control pin is thereby, due to an axially directed spring support with respect to the control bolt, pressed out of the respective indentation and is moved relative to the valve chamber opening, whereby the compressed air supply is produced in a known manner by this relative movement, and a pneumatic connection for pin extraction suction is provided via the valve chamber openings.

The head of the valve control pin and the indentation or indentations are then advantageously constituted such that it is substantially possible for the valve pin head to slide into and out of the indentation.

In a positive development of the invention, it is furthermore possible to install several indentations of different depths on the control pin or control bolt, in order to control the intake suction or exhaust suction pressure of the pin extraction. If for example several such recesses of different depth are arranged in succession on the underside of the control bolt, there is the possibility of controlling the air pressure with respect to pin suction by pressing the control bolts into this opening more or less strongly, since the axial relative movement of the valve pin is of a different magnitude depending on the depth, and thereby the valve, which controls the air flow for pin extraction, is opened to different degrees. It has to be noted here, however, that the relative stroke of the valve control pin should overall be smaller than the stroke movement of the valve rod which, when it was pressed downward by the press button, cuts off the compressed air supply and then drives the hydraulic piston.

Such recesses can of course also be installed along a circumferential line on the surface of the control bolt. This is particularly of advantage when the control pin is mounted in the opening so as to be rotatable around its axis.

In this connection, there is also the possibility within the scope of the present invention of obtaining a continuous, substantially linear rise of the intake or exhaust pressure, such that this linear rise is also directly revealed to the user upon operation of the control bolt. As already mentioned hereinabove, the valve control pin in the closed state of the valve is subjected to a prestress which is produced by a spring connected to the valve pin by means of a valve ball. As is known to one skilled in the art, the force effect of the spring on the valve pin increases with the square of the distance from the inoperative position. If the course of the indentation is adjusted to this quadratic change, a linear course of the deflection of the spring or of the valve pin is obtained in dependence on the force which is exerted by the control bolt on the spring by means of the valve control pin. In this manner, a systematic setting of the exhaust or intake pressures by the user of the riveting tool is possible. However, it is thereby also possible for the user of the riveting tool, in a very simple manner, to develop experimental values of what pressure setting, and hence what depth of pressing in, is required for which rivets. Such an arrangement of the valve device with valve chamber, valve chamber portion, valve pin and control bolt can hence contribute to simpler manipulation of the riveting tool according to the invention by means of the above-described very positive development of tool ergonomics.

Furthermore, it is very appropriate and advantageous to make the working surfaces of the control bolt on the head of the valve control pin substantially wedge-shaped. Such a shape has in particular been found to be very advantageous when a tiltable control bolt is used. The control pin can thus be pushed in the axial direction by the control bolt in a substantially optimum manner, and furthermore the axial displacement length can be set very easily by means of the height of the wedge.

In a positive development of the subject of the invention, this also includes a resetting device to simplify the actuation of the control pin. In a simple embodiment, the resetting device substantially only serves to convey the control bolt or control pin which has been pressed into the opening back to its initial position after load has been removed from it. For such a simple design, the resetting device has a resetting spring as the important component. Other current mechanisms which are familiar to one skilled in the art are of course also within the scope of the invention and, for example as regards the depth of pushing in, a graded setting of the control bolt can be obtained by means of them. Such a device could, for example, be a multiple spring system.

Furthermore the riveting tool according to the invention has a side plate in such a positive form that the control pin or control bolt can be actuated by means of this for the control of the air supply to the pneumatic device for transporting away the broken-off rivet pins. Such a side plate has two positive properties, among others. Firstly, holding of the riveting tool is facilitated by the shape, oriented to the gripping hand, of the side plate; and secondly, a selective pressure on the gripping hand, arising due to actuating of the control bolt, can be distributed over the whole hand surface. The side plate according to the invention thus also serves an important aim of the invention, which is based on the optimization of the riveting tool both functionally and also ergonomically, in order to contribute in this manner to improved ease of manipulation, to increased working safety, and to the prevention of work interruptions.

However, according to the invention, the set object can be realized, not only by a purely mechanical pneumatic valve or valve device controlled by a control bolt, i.e. as shown in the preceding embodiment example, but also by means of a valve which is to be controlled by electromechanical means. An important advantage of such valves is that they can be very specifically controlled, so that good metering-out of the compressed air is possible. The said valve affords in this manner properties which are also known to one skilled in the art from so-called throttles in the field of compressed air control, and which make possible a continuously variable pressure setting.

The electromechanically controlled valve is found to be particularly advantageous in the field of the invention, in particular when the electrical control of the valve takes place by means of a sensor. A switching of the pneumatic valve is then possible in the most advantageous manner, according to the embodiment of the sensor, by a simple coming into contact with the sensor, or a slight pressure on it. For example, depending on the weight of the riveting tool and its field of use, sensors can be chosen which are to be actuated in different ways. Thus a whole palette of sensors can be used, depending on the purpose of application. These can be, for example, electro-optical, -mechanical, -capacitive, -resistive, and -calorimetric or temperature-dependent sensors. Combinations of the said sensors are of course also possible. When electromechanical sensors are used, pressure sensors, for example silicon-based, can be used, among others, and are distinguished by a particularly small overall size and can therefore very advantageously be integrated into the riveting tool according to the invention.

The use of sensors has furthermore been found to be very positive in that a linear control of the electromechanical valves is possible in a simple manner; as mentioned hereinabove, this can be of great importance for the specific changing of the air pressure.

For the optimization of the control behavior, the riveting tool according to the invention includes, in a highly advantageous development, a processing device or a microprocessor for the processing and control of the signals produced and transmitted by the sensor, by means of which device the processing of the data transmitted by the sensor takes place. The data processing can consist, for example, in that defined operating profiles are presettable, i.e., in which it is defined how much the valve opens for the control of the extraction suction device, for a given pressure on the sensor. The production of linearized pressure data, as abovementioned, is also related to this. As well as pure linearization, it is of course also possible to change the steepness or the rise of the linear sensor signal, in order in this manner to vary the response behavior.

In a manner according to the invention, the sensor is included as an actuating member in the actuating device. Thereby, particularly when it is arranged beneath the press button, the pressure sensor is directly accessible to the user by means of the gripping hand when gripping the riveting tool, whereby a direct contact with the actuating sensor is produced, in an analogous manner to the control bolt which has already been described.

Based on a particularly positive ergonomic aspect, and according to this embodiment of the invention, the pressure sensor can be integrated as an actuating member into the side plate. Thereby, in a corresponding manner as with the control bolt, the actuating surface is uniformly distributed. In this embodiment, it does not stringently depend only on a uniform distribution of the actuating load or of the actuating pressure, which is in some circumstances necessary in a control bolt which is actuated purely mechanically, but in particular on the ergonomically optimized actuation, to distribute the regulation of the air pressure to several fingers of the hand and/or to the hand surface. An optimum balance is provided by such an integration between the static gripping of the riveting tool and the control of the extraction air pressure. It furthermore falls within the scope of the invention to set a threshold value by means of the said processing device. The threshold value is then set, for example, so that the electromechanical valve is first completely connected through after a given and predetermined contact pressure, which has previously risen linearly, on the sensor, in order thus to commence the intake suction process proper. Among other things, the compressed air usage can be reduced with the threshold setting shown.

In an advantageous development of the subject of the invention, the riveting tool also includes a transmitting device and/or receiving device by means of which external appliances can be communicated with or controlled by means of analog or digital signals. Such appliances can for example be compressor devices and/or also external valves by means of which the compressed air supply can be controlled via the transmitter device, starting from the pressure sensor. Correspondingly, the pneumatic valve installed on the riveting tool can either be completely omitted or can be used in a pressure-controlled form.

The riveting tool furthermore includes an energy supply device. The supply by means of electrical energy in particular can also, as is the case with other appliances, e.g. cordless telephone appliances and portable computers, take place by means of accumulators or batteries, depending on the energy requirement, or by a connection to the supply mains.

The invention will be described in detail hereinbelow with reference to the accompanying drawings and to preferred embodiments. Here like, or similarly operating, features are given the same reference numerals.

Figure 1:
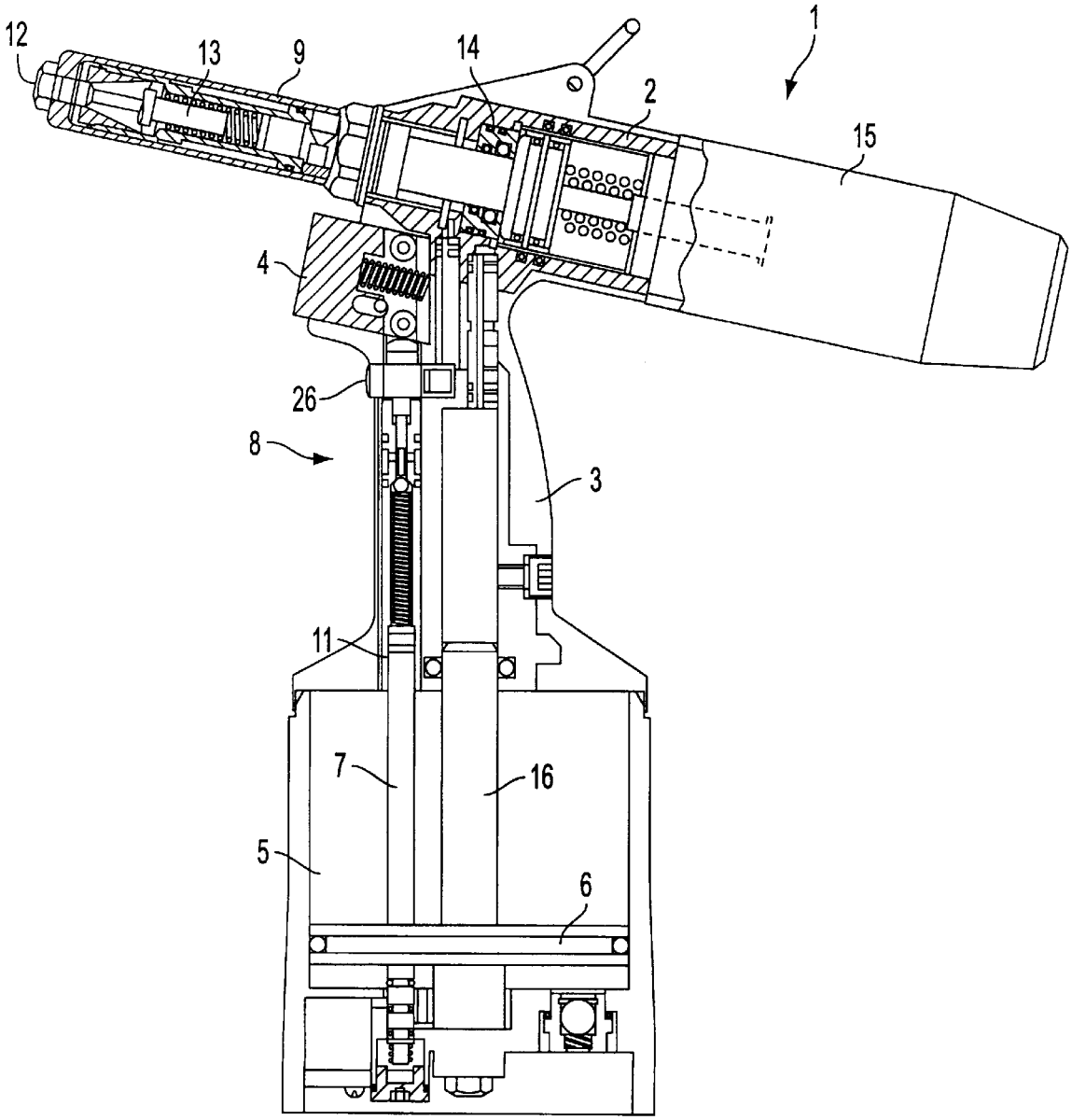
FIG. 1 shows a cross section of the riveting tool in the vertical direction in about the plane of the longitudinal axis of the riveting tool.

A cross section of the riveting tool as a whole is given in FIG. 1. Three basic elements of the riveting tool 1 are to be distinguished here. These are the riveting tool head 2, which is connected to the pneumatic cylinder 5 by means of the handle portion 3.

The pneumatic piston 6 moves in the pneumatic cylinder 5. A valve rod 7 is arranged parallel to the longitudinal axis of the pneumatic cylinder 5. The valve rod 7 connects the compressed air connection on the underside of the riveting tool with the valve device 8 for the air supply for the pin extraction 9. The longitudinally displaceable valve rod 7 pushes the pneumatic piston 6 through; the valve rod is sealed with respect to the pneumatic piston. The valve device 8 and valve rod 7 move in the receiving bore 11.

The pneumatic connection 10 is formed as a lateral bore to the receiving bore 11 of the valve device. It provides a connection between the valve device 8 and the annular space of the pneumatic pin extraction 9 for carrying away brokenoff pins.

The pin extraction 9 itself was already described in the Patentschrit [Granted Patent] DE 31 25 838, so that this is completely incorporated herein by reference.

The pin extraction 9 is arranged in the head 2 behind a mouthpiece 12 for receiving blind rivets, so that the rivet pin, gripped by the chuck 13 and broken off by the force from the hydraulic pressure piston 14, is carried away by the pin extraction 9 into a collecting container 15. The return of the pressure piston 14 is effected in a manner known per se by the advance of the hydraulic piston 16, which is mechanically connected to the pneumatic piston 6, under the control by means of the position of the valve rod 7.

The valve device 8 and the longitudinally displaceable press button 4 are arranged above the valve rod 7, i.e., in the region of the handle portion 3 of the riveting tool according to the invention.

Figure 2:
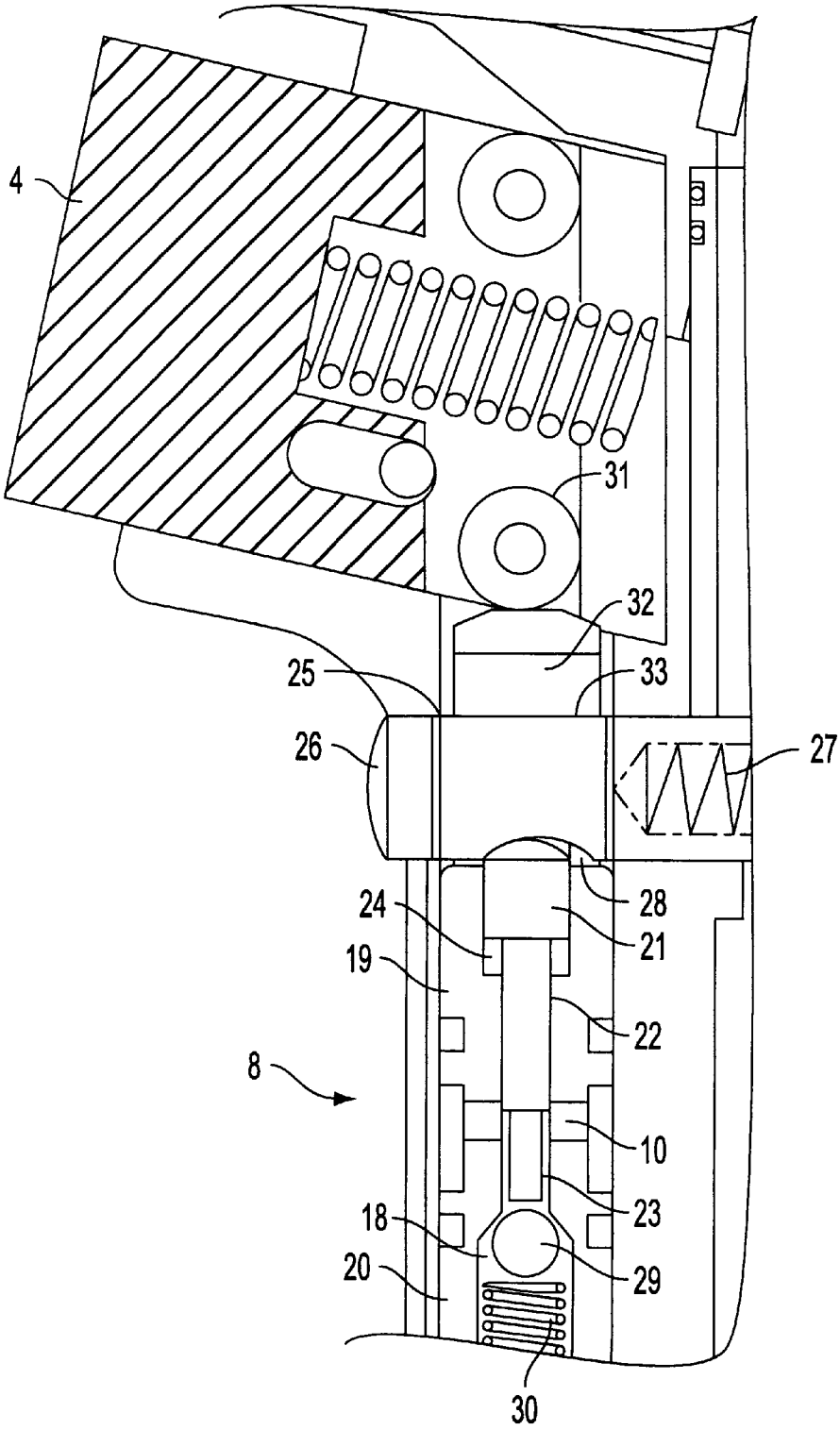
FIG. 2 shows a detail of the cross section from FIG. 1, showing the valve device according to the invention in enlarged form.

The valve device 8, which can again be seen in detail in FIG. 2, includes as well as the press button 4 an axially displaceable valve control pin 17 which is arranged within the valve chamber 18. The valve chamber 18 is formed by a first valve chamber portion 19 and a second valve chamber portion 20.

The valve control pin 17 includes, in a form like a mushroom, a total of three portions which differ in diameter. The valve pin head 21 forms in this picture the mushroom cap; this has a spherical segment or cylindrical segment shape, or else a parabolic shape. The guide shaft 22 of the valve pin 17 is located beneath, and has a smaller than, the valve pin head 21. The valve pin extension 23 adjoins the guide shaft 22, and again has a smaller diameter than the valve pin head 21 and the valve pin shaft 22.

The valve pin 17 is guided in the valve chamber 18 within a middle valve bore 24 which has two different diameters. The portion of larger diameter matches the diameter of the valve pin head 21; the second section serves to guide the guide shaft 22 of the valve pin 17. The axial play of the valve pin 17 is determined in the abovementioned embodiment substantially by the depth of the larger-diameter portion of the valve rod bore 24 or by the height of the valve pin head.

The second valve chamber portion 20 likewise includes, in a comparable manner to the first valve chamber portion 19, a bore arranged in the middle and having two different diameters; the bores with the respectively smaller diameters of the valve portions 19 and 20 are situated opposite each other in the valve device 8. The transition between the two cross sections of the second valve chamber is formed in a conical shape, so that this does not occur abruptly but gradually. The conical surface acts here as a sealing and guide surface for a valve ball 29 which was movably installed directly beneath the conical surface, in the bore portion with the larger diameter, and which has a larger diameter than the smaller cross section of the second valve chamber portion, and which is supported by a spring 30 located beneath it so that the ball is acted on by a force toward the conical surface and thus abuts in the inoperative state on the conical transition surface and closes the transition airtightly.

The so-called control bolt 26 is accommodated in an opening or bore 25 transverse to the longitudinal axis of the valve chamber above the first valve chamber 18 or the valve pin 17. A spring 27 is situated at the floor of the opening and contacts the portion of the control bolt 26 situated in the opening. The function of the spring 27 is to hold the control bolt 26 from the other side and to reset it from the pressed state. The control bolt 26 has an indentation 28 on the underside of the surface, in the form of a cylindrical segment or a spherical segment and substantially matching the head shape of the valve pin 17. FIG. 2 shows the valve control bolt 26 in the non-pressed state. In the maximally pressed case, the valve pin strikes against the underside of the flat front portion of the control bolt 26 outside the indentation 28. However, two intermediate states are also possible, in which the valve device 8 is not completely opened for extraction, so that the possibility exists of sucking in rivets of different thicknesses more or less strongly, thereby holding them on the mouthpiece of the riveting tool. However, such states can also be effected when more projections or indentations 28 are installed underneath the control bolt 26, and lift the valve pin 17 more or less strongly upward, or else when the indentation 28 has a suitable form, so that it runs, for example, parabolically or exponentially.

In the fully pressed state of the control bolt 26, the valve pin 17 is pressed via the valve ball 29 against the spring 30. Then by the axial movement of the valve pin 17, the valve ball 29 is lifted from its seat and in this manner provides a compressed air connection between the middle bore of the second valve chamber 20 via the bore 10 to the pin extraction 9.

The riveting process proper is also furthermore actuated by the press button 4. The displacement movement of the press button 4 is transmitted, by a stop 31 formed as a roller, to the connecting member 32; this then acts through a through opening or recess 33 of the control bolt 26 and acts on the first valve chamber portion 18 and presses this downward, in common with the valve rod 7, and thus controls in a known manner the pneumatic piston 6 or the hydraulic cylinder 16 and the press piston 14. It is important in this connection that the maximum displacement extent of the valve rod 7 in the present embodiment example was kept smaller, by means of the control bolt 27 via the valve pin 17, the valve ball 29, and the valve spring 10, than the displacement extent of the valve rod 7 obtainable by maximum pressing of the press button 4. Displacement extents of 1 mm or the maximum stroke of the valve control pin and 1.5 mm for the maximum displacement of the valve rod have been found to be advantageous.

Not shown in FIGS. 1 and 2 is the hand plate or side plate developed within the scope of the subject of the invention. The side place is fitted to the handle portion 3 in the riveting tool according to the invention and engages with its lower side over the control bolt 26. The side plate has two advantages. Firstly it enables better gripping of the riveting tool 1 according to the invention, and secondly, serves to distribute possible one-sided pressure loadings by the control bolt over the whole inner side of the hand.

Figure 3:
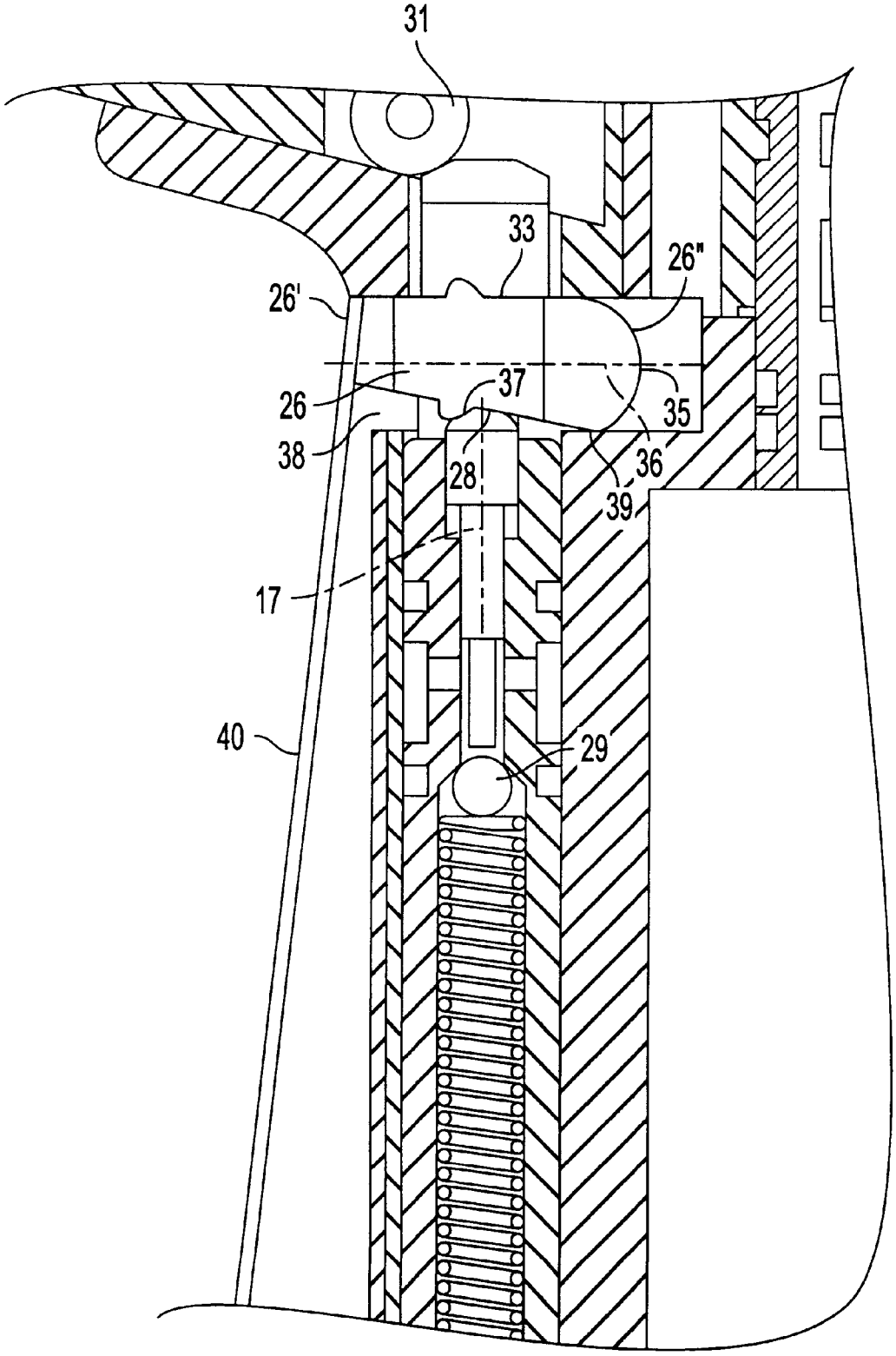
FIGS. 3 and 4 show two cross sections of the riveting tool, which show two different states in the field of a further mechanical embodiment of the valve device according to the invention.
Figure 4:
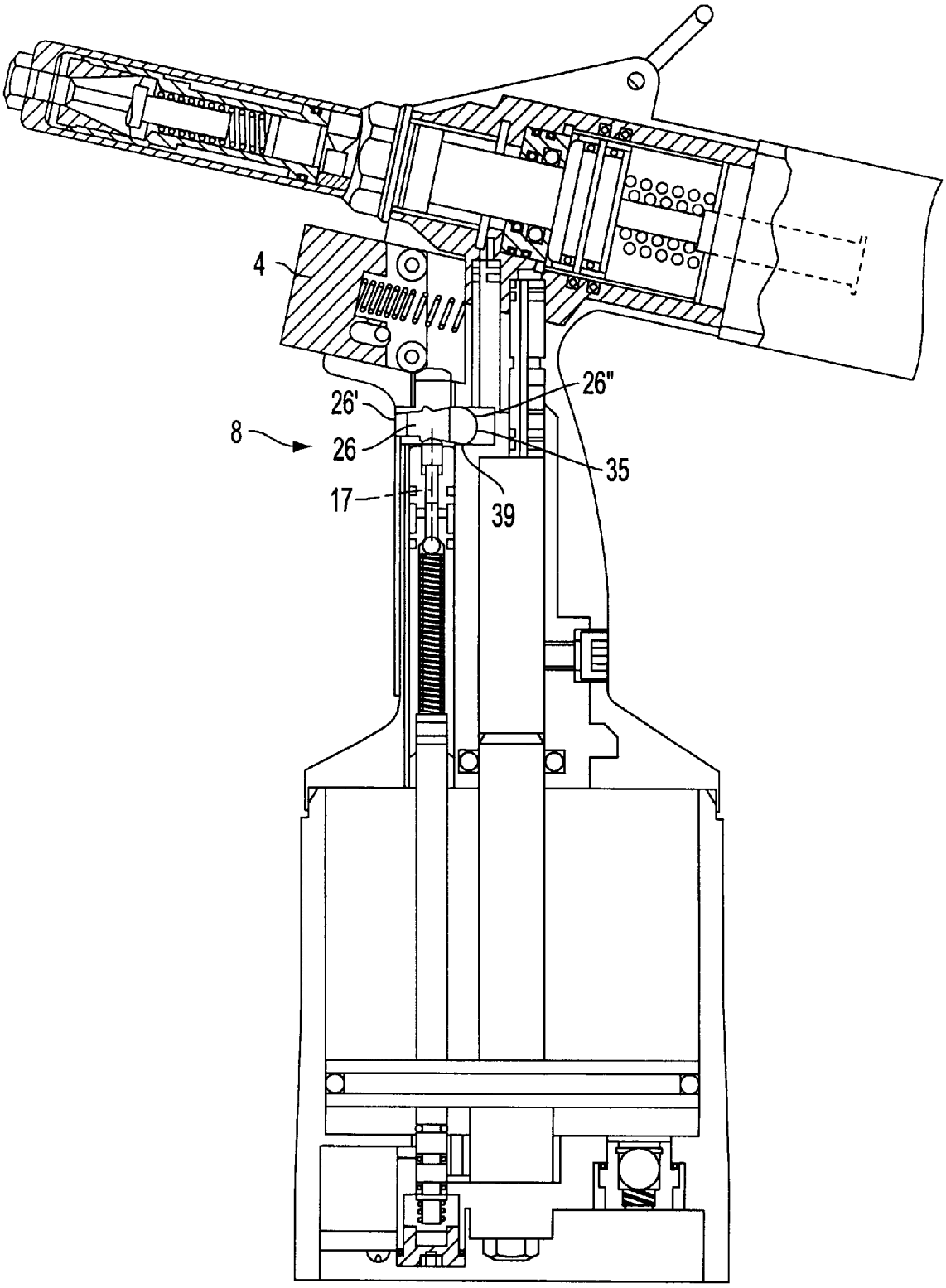

A further embodiment example of the valve device according to the invention is shown in FIGS. 3 and 4. Two different states of the embodiment according to the invention are shown. In comparison with the embodiment example described hereinabove, the control bolt departs more strongly from a purely cylindrical form. However, for constituting the control bolt as the basic or starting member, a cylindrical form is preferably used. Basic members with square, rectangular, or arbitrary cross sections can of course also be used.

Depending on the basic member, the control bolt 26 is inserted into a bore 25 with oval, square, rectangular, or round cross section, fitting exactly, i.e. with a suitable tolerance, with reference to its largest cross section.

If the basic member is a cylinder, the end portion 2" of the control bolt is constituted in a preferred manner in the form of a spherical segment, which either meets a concave bore floor 35 shaped to fit it, or a valve plate, matched in a corresponding manner, of the bolt spring 27 which can be optionally installed on the floor of the opening. The surfaces in contact have a structured surface so as to permit ensuring slidability between the control bolt 26 and abutment 35 in both cases. Thus the effect of the end portion 26" of the control bolt 36 is similar to a ball joint.

It is furthermore apparent from FIG. 3 that in the sectional representation shown the underside of the control bolt 26 is beveled with respect to the longitudinal direction of the bolt 26, and hence the cross section of the control bolt 26 tapers from its rounded portion toward its head portion 26'. The surface of the head side 26' of the control bolt 26 was constituted such that this is perpendicular to the beveled underside of the control bolt 26, so that the head side surface includes an obtuse angle with the longitudinal axis of the control bolt.

The control bolt shown in FIGS. 3 and 4 can optionally have an additional rotary mounting in the form of a rotation axis 36. The rotation axis then preferably runs through the center of the circle of the circular segment which is situated opposite to the head side 26', and is perpendicular to the surface spanned by the longitudinal axes of the control bolt 26 and of the valve pin 17. It is insured in this manner that the control bolt 26 can be tilted substantially with respect to the longitudinal axis of the valve pin 17.

The vertical stroke which can basically be effected by the tilting of the control bolt with respect to the aperture of the bolt bore 25 substantially depends on the arc length which can be swept over by the working point 37 on the underside of the control bolt. The arc length is a function both of the tilting angle 38 which is included, as already described, between the oblique underside of the control bolt 26 and the longitudinal axis, and also on the distance which is substantially defined by that of the working point 37 and the rotation point 39 on the underside of the control bolt 26. As the "working point" or "wording surface" there is indicated substantially the point or the surface which is put in position on the head 21 of the valve pin 17. By "rotation point" 39 there is meant the partial region on the underside of the bolt at which the control bolt underside comes into abutment or contact for the first time with the control bolt bore 25.

The working point or the wording surface 37 includes, as can be seen from FIG. 3, a wedge-shaped elevation which is taken outward. The elevation is constituted such that, with respect to the control bolt surface in the direction toward the tapered side 26' of the control bolt 26, it first rises at an acute angle and after a rounded tip or edge falls substantially perpendicularly. The rise is of arcuate shape, so that this matches the curvature of the valve pin head 17. A corresponding elevation is also situated on the opposite side of the control bolt 26.

Furthermore, a lever 40 for the actuation of the control bolt 26 is installed on the head side 26' of the control bolt 26 which slightly projects beyond the opening edge of the opening 25. The control lever 40 has an end firmly fixed flat to the head side 26' of the control bolt 26 and runs obliquely spaced from the riveting tool shaft 3. By this fastening, the control lever 40 includes substantially the same angle with the longitudinal axis of the control bolt 26 as the head side surface 26' with the longitudinal axis, and has, relative to the handle portion 3 or the longitudinal axis of the valve pin 17, substantially the tilt angle 38 of the control bolt 26 with respect to the oblique underside of the control bolt 26.

The control bolt 26 in the inoperative state within the bore 25 allocated to it can be seen in FIG. 3. The side of the control bolt 26 remote from the valve pin 17, which preferably lies parallel to the longitudinal axis of the control bolt 26, is here located in abutment with the bore wall of the bolt bore 25. This position is furthered in that the valve pin head 21 presses by means of the valve spring 30 via the valve ball 29 against the abutment face 37 on the underside of the control bolt, and the control bolt 26 is thus held in abutment with the upper side of the bolt bore.

If the control lever 40 is pressed by the gripping of the riveting tool on the shaft 3 of the riveting tool 1 (see FIG. 4 in connection with this), the control bolt 26 is thereby pressed downward in the bore 25, or the underside of the control bolt 26 is placed in the perpendicular to the longitudinal axis of the control pin 17. As a consequence of this tilting movement, the working point or the working surface 17 presses on the head 21 of the valve pin 17 and displaces this axially downward in the direction toward the valve ball, which is held by the valve spring 30 in the sealing seat. Due to this vertical movement, the valve ball 29 is lifted off the sealing seat and in this manner opens the valve apparatus 8 and thus establishes a pneumatic connection with the annular space of the rivet extraction suction device 9 via the opening 10. The intake suction pressure can thus be controlled, when different strengths of actuation of the control lever 40 result in different extents of opening of the valve device 8. Such a variable mode of operation is in particular desired with the use of rivets of different strengths, since stronger rivets require a greater intake pressure for holding in the mouthpiece than do weaker rivets. The remaining functional and structural features correspond to those already described in connection with FIGS. 1 and 2.

Furthermore, as a further addition, a bolt spring as has already been described hereinabove can be arranged on the control bolt as shown in FIGS. 3 and 4. Such a combination makes it possible to connect together the manner of functioning of the control bolt according to the embodiment example of FIG. 1 or 2 and that from FIGS. 3–5. This means that the control bolt 26 is not only arranged to be able to tilt, but can also be pressed into the bore 25, in order thus to control the valve apparatus 8. It can also be appropriate in some circumstances to suspend the control bolt 26 on the abovementioned tilt axis. The tilt axis should then be flexibly suspended in the opening such that its ends run in grooves which were notched in the bolt bore wall and which have different detent points in which the tilt axis finds a certain resisting force, which also however makes it possible to displace the control bolt from detent point to detent point in the longitudinal direction within the bore.

Figure 5:
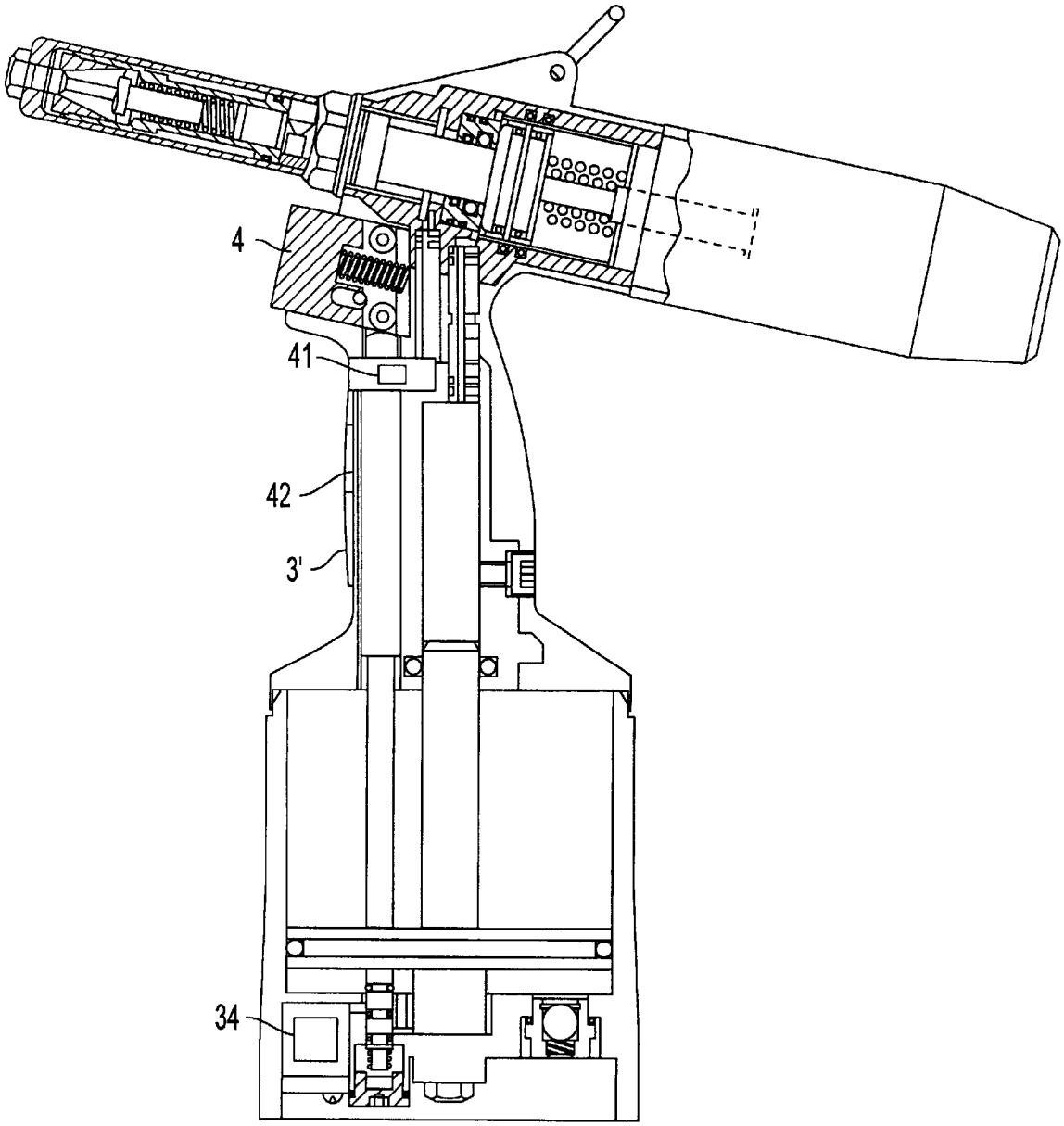
FIG. 5 shows a cross section of the riveting tool, showing schematically a sensor-controlled embodiment of the riveting tool.

A further possible embodiment of the subject of the invention is shown in FIG. 5. This schematically represents a pneumatic valve 41, a sensor 42 and an energy supply device 34. The pneumatic valve 41 was arranged in the region of the valve device 8 corresponding to FIGS. 1–4, beneath the press button 4, and in an analogous manner controls the compressed air supply to the pin extraction 9. The valve type however depends on whether the valve is responded to electromechanically or pneumatically. In the present embodiment, an electromechanical control is preferred. The control signals are produced by the sensor 42. The sensor 42 was installed a little below the pneumatic valve 41 in the present embodiment. It is situated in the handle region 3 of the riveting tool according to the invention and was integrated into the side plate 3' which is very schematically shown in FIG. 3. The sensor 26 in FIG. 3 was not shown to scale. It can however be seen from FIG. 3 that the actuating region of the sensor 42 takes up a larger surface beneath the direct gripping surface of the side plate. It is insured by means of this surface that as uniform as possible a contact can take place on the sensor via the handle switch. The processing of the control signals produced by the sensor takes place by means of a processing device (not shown) which is allocated to the sensor 42 or is arranged on the sensor 42, and which can also include a microprocessor. The processing unit can for example control the course of the signal linearly, exponentially, etc., which in the sequence controls the degree of opening of the valve 41. Furthermore a signal threshold can also be set by means of this, according to which the pneumatic valve 41, for example, fully switches through.

Numerous different sensor types can be used for the sensor 42. Depending on the use of the riveting tool 1, these can be mechano-optical, -capacitive, -resistive, and -temperature dependent and electro-optical, -capacitive, -resistive, and -calorimetric sensors.

For the energy supply to the riveting tool 1, accumulators or batteries 34 are particularly used, insuring that the riveting tool is independent of location. Conventional mains connections can of course also be used. These have weight advantages, particularly for carrying during application for a long period of time.

The riveting tool 1 is also capable of sending or receiving signals of external devices, for example, to control these or to accept control signals from these, by means of a transmitter and/or receiver which can be used according to the invention, in the scope of the actuating device 26 or the above-described processing device. Thus it is possible by means of the sensor 42 to control a compressor or an external pneumatic valve by means of the transmitter. The compressed air supply and the pressure of the compressed air are then no longer controlled by the valve arranged on the riveting tool, but can be regulated in a simple manner by external valves.

In an alternative development, it is furthermore possible, by the controlled external supply of compressed air, to control the valve 8 pneumatically, so that this is either closed or opened according to the pressure conditions.

Reference Numerals

| | | | |
|---|---|---|---|
| 1 | riveting tool | 19 | first valve chamber portion |
| 2 | riveting tool head | 20 | second valve chamber portion |
| 3 | handle/3" side plate | 21 | valve pin head |
| 4 | press button | 22 | valve pin shaft |
| 5 | pneumatic cylinder | | |
| 6 | pneumatic piston | | |

-continued

Reference Numerals

| | | | |
|---|---|---|---|
| 7 | valve rod | 23 | valve pin projection |
| 8 | valve device | 24 | valve bore |
| 9 | pin extraction | 25 | bolt bore |
| 10 | pneumatic connection | 26 | control bolt or pin |
| 11 | valve receiving bore | 26' | control bolt head portion |
| 12 | mouthpiece | 26" | control bolt end portion |
| 13 | tool chuck | 27 | bolt spring/sensor |
| 14 | hydraulic pressure cylinder | 28 | indentation |
| 15 | collecting receiver | 29 | valve ball |
| 16 | hydraulic piston | 30 | spring |
| 17 | valve control pin | 31 | roller |
| 18 | valve chamber | | |
| 32 | connecting member | | |
| 33 | recess | | |
| 34 | energy source | | |
| 35 | bore floor | | |
| 36 | rotation axis | | |
| 37 | working point | | |
| 38 | tilt angle | | |
| 39 | rotation point, rotation surface | | |
| 40 | control lever | | |
| 41 | pneumatic valve | | |
| 42 | sensor | | |

I claim:

1. A riveting tool for setting at least one of blind rivets and bolts with lock washers, comprising:

a mouthpiece to receive said at least one of blind rivets and bolts, a pneumatic device to carry away broken-off rivet pins from said riveting tool, a pressable device arranged on said riveting tool that releases a course of functions relating to a riveting process, a valve device for supplying air to said pneumatic device to carry away broken-off rivet pins from said riveting tool, and a handle to hold said riveting tool, wherein said valve device (8) includes an actuating device (26) that controls said air supplied to said pneumatic device (9) to carry away broken-off rivet pins, said actuating device (26) being arranged on said handle (3).

2. The riveting tool according to claim 1, wherein said actuating device (26) is arranged underneath said pressable device.

3. The riveting tool according to claim 1, wherein said actuating device (26) includes a control bolt or pin (26) for manually actuating a valve control pin (17).

4. The riveting tool according to claim 3, wherein said control bolt or pin (26) is arranged in an opening (25) and is movable in said opening (25) in at least one of a longitudinal direction or and at an angle to said longitudinal direction.

5. The riveting tool according to claim 4, wherein said control bolt or pin (26) is rotatably mounted on one side in said opening (25).

6. The riveting tool according to claim 3, wherein the cross section of said control bolt or pin has at least one end and a cross-section that is tapered toward said at least one of its ends end.

7. The riveting tool according to claim 3, further comprising a lever arm, wherein said control bolt or pin (26) is actuatable via said lever arm (40).

8. The riveting tool according to claim 3, wherein said valve device (8) comprises a valve control pin (17) having a head (21) and said control bolt or pin (26) abuts a head side of said valve control pin (17) and has at least one of an indentation and a projection (28,37) as a working surface to axially move said valve control pin (10).

9. The riveting tool according to claim 8, wherein said indentation has a working surface (28) with a parabolic shape.

10. The riveting tool according to claim 8, wherein said projection has a working surface substantially with a wedge shape.

11. The riveting toll according to claim 3, wherein said handle (3) comprises a handle shell (3) and said control bolt or pin (26) is actuatable via said handle shell (3).

12. The riveting tool according to claim 3, wherein a resetting device (27) is provided on said control bolt or pin (26) to mechanically reset said control bolt or pin (26) after is actuated.

13. The riveting tool according to claim 1, wherein said valve device (8) comprises a valve control pin (17) having a head (21), and said actuating device (26) comprises a control bolt or pin (26) arranged on a head side of said valve control pin (17).

14. The valve device (8) to control an air supply to a pneumatic device (9) to carry away broken-off rivet pins of a rivet pins of a riveting tool according to claim 1, comprising:

a valve chamber (18) with at least one opening (11), at least one valve chamber portion (19, 20) with at least one of axial passages and radial passages (10), a valve pin (17) guided by said axial passages (10) of at least one of said valve chamber portions (19, 20), and a control bolt or pin (26) at a head side of said valve pin (17) that controls said valve device (8).

15. The riveting tool according to claim 1, wherein said valve device (8) includes an electromechanically controlled pneumatic valve.

16. The riveting tool according to claim 1, wherein said actuating device includes a sensor.

17. The riveting tool according to claim 16, further comprising a processing device for processing of signals supplied by said sensor (26).

18. The riveting tool according to claim 16, further comprising a shell (3') of said handle wherein said sensor (26) is arranged on a said shell (3') of said handle.

19. The riveting tool according to claim 1, further comprising at least one of a transmitting device and a receiving device that transmits or receives electromagnetic signals respectfully.

20. The riveting tool according to claim 1, wherein said valve device (8) includes a pneumatically controlled pneumatic valve.

21. The riveting tool according to claim 1, further comprising an energy supply device (34) that supplies electric power for said riveting tool.

* * * * *